US005386979A

United States Patent [19]

Müller

[11] Patent Number: 5,386,979

[45] Date of Patent: Feb. 7, 1995

[54] ROTARY FOLDING APPARATUS WITH A SPECIAL CYLINDER ARRANGEMENT FOR WEB-FED ROTARY PRINTING PRESSES

[75] Inventor: Hans Müller, Leimen, Germany

[73] Assignee: Heidelberger Druckmaschinen AG, Heidelberg, Germany

[21] Appl. No.: 33,151

[22] Filed: Mar. 16, 1993

[30] Foreign Application Priority Data

Apr. 16, 1992 [DE] Germany ..... 4208353

[51] Int. Cl.[6] ..... B41L 43/08; B41F 13/58

[52] U.S. Cl. ..... 270/42; 270/7; 270/21.1; 493/359; 493/458

[58] Field of Search ..... 270/4, 5, 6, 7, 8, 9, 270/10, 11, 18, 19, 20.1, 21.1, 41, 42, 43, 44; 493/357, 359, 458, 324, 429

[56] References Cited

U.S. PATENT DOCUMENTS

| | | | |
|---|---|---|---|
| 4,564,470 | 1/1986 | Schmitt | 270/5 X |
| 4,746,107 | 5/1988 | Schneider et al. | 270/21.1 |
| 4,861,326 | 8/1989 | Kühner et al. | 493/359 |
| 5,024,128 | 6/1991 | Campbell, Jr. . | |
| 5,037,076 | 8/1991 | Stab | 270/6 X |
| 5,065,993 | 11/1991 | Reponty . | |

FOREIGN PATENT DOCUMENTS

| | | | |
|---|---|---|---|
| 3626287 | 2/1988 | Germany . | |
| 3614263 | 10/1989 | Germany . | |
| 3904074 | 8/1990 | Germany . | |
| 4005028 | 8/1990 | Germany . | |
| 295374 | 12/1988 | Japan | 270/21.1 |
| 1299332 | 12/1972 | United Kingdom . | |

*Primary Examiner*—John T. Kwon
*Assistant Examiner*—John Ryznic
*Attorney, Agent, or Firm*—Herbert L. Lerner; Laurence A. Greenberg

[57] ABSTRACT

Folding apparatus for signatures having a given format includes at least a first longitudinal folding device, a plurality of cylinders arranged in succession thereafter and followed by at least a second longitudinal folding device. Also included are a cylinder section having a base frame, and two cross-fold systems operatable independently of one another and integrated in the base frame. Each of the cross-fold systems has cylinders for guidingly carrying signatures having a given format, the signature-carrying cylinders being of such diameter as to have an outer cylindrical surface extending over the circumference thereof adequate for carrying one behind the other at one time at least two of the signatures having the given format.

16 Claims, 5 Drawing Sheets

Figure 1A:
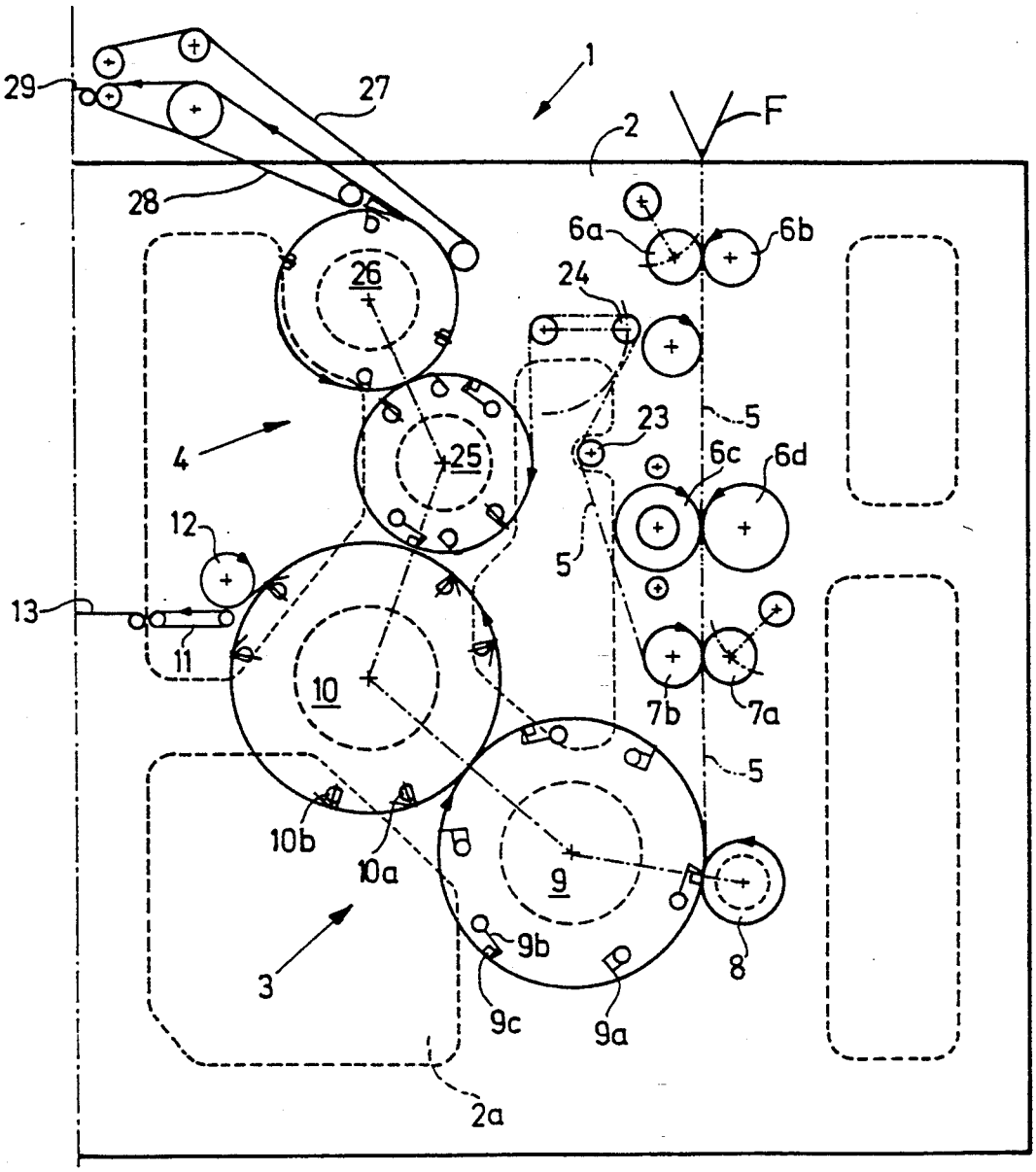

ROTARY FOLDING APPARATUS WITH A SPECIAL CYLINDER ARRANGEMENT FOR WEB-FED ROTARY PRINTING PRESSES

SPECIFICATION

The invention relates to a folding apparatus having a special cylinder arrangement for web-fed rotary printing presses, especially for separate product deliveries of a 2×4-page to 2×16-page production.

From the state of the art, as exemplified by published German patent document 36 26 287 A1, a configuration of a folding apparatus has become known heretofore which, starting with a base frame to be installed, can be expanded without delay. For this purpose, beginning with an intermediate frame to be installed laterally of the base frame, an additional frame is arranged on an even level with the base frame whereon, if necessary, multipartite superstructures can be mounted or assembled. This heretofore known configuration of a folding apparatus permits the formation of complete cross-fold systems; however, only by supplementing it with laterally attachable intermediate frames and by providing an additional superstructure laterally above, both of which being equipped with a folding cylinder. By such an expansion with a lower intermediate frame and an elaborate conveyor belt system connected therewith, costly installation space is given up. Furthermore, the free space located below between the intermediate frame and the accessory frame, and bridged by the conveyor belt system, requires an accordingly long and, therefore, costly train of conveyor belts in the superstructure. The train of conveyor belts is followed first by the longitudinal folding devices, to which an additional module for combining or uniting the product streams can be connected. The folding apparatus is thereby unduly expanded in the length thereof and considerable strain is placed unnecessarily on the existing adjusting or installation space.

In view of this state of the art, it is an object of the invention to provide a folding apparatus having a special cylinder arrangement for web-fed rotary printing presses and having a configuration which is optimized so that, among other modes of production, a separate 2×4-page to 2×6-page production requiring a minimal number of cylinders and limited amount of installation space can also be realized.

With the foregoing and other objects in view there is provided, in accordance with the invention, a folding apparatus for signatures having a given format, the folding apparatus including at least a first longitudinal folding device, a plurality of cylinders arranged in succession thereafter and followed by at least a second longitudinal folding device, and comprising a cylinder section having a base frame, and two cross-fold systems operatable independently of one another and integrated in the base frame, each of the cross-fold systems comprising cylinders for guidingly carrying signatures having a given format, the signature-carrying cylinders being of such diameter as to have an outer cylindrical surface extending over the circumference thereof adequate for carrying one behind the other at one time at least two of the signatures having the given format.

In accordance with another feature of the invention, one of the cross-fold systems comprises a pin cylinder, a jaw cylinder and a gripper/tucker-blade cylinder in successive rotary engagement with one another.

In accordance with a further feature of the invention, means are provided which define a substantially vertical transport path for at least one web length to the one cross-fold system.

In accordance with an added feature of the invention, a cutting cylinder is operatively associated with the one cross-fold system.

In accordance with an additional feature of the invention, a longitudinal-fold system is provided adjacent the one cross-fold system, as well as means for conveying a stream of signatures from the one cross-fold system to the longitudinal-fold system.

In accordance with yet another feature of the invention, one of the cross-fold systems comprises a gripper/-tucker-blade cylinder and a cutting/jaw cylinder in mutual rotary engagement.

In accordance with yet a further feature of the invention, means are provided defining a transport path for at least one web length to the one cross-fold system.

In accordance with yet an added feature of the invention, the path-defining means are cooperatively engageable diverting and guide rollers, and a regulating roller is disposed downstream therefrom in transport direction of the one web length.

In accordance with yet an additional feature of the invention, means are carried by the gripper/tucker-blade cylinder and the cutting/jaw cylinder for cutting off a signature from the one web length.

In accordance with still another feature of the invention, the means for cutting off the signature comprise at least two cutting bars and at least two blades.

In accordance with still a further feature of the invention, at least two gripper bars are carried by the gripper/tucker-blade cylinder.

In accordance with still an added feature of the invention, at least two rows of pins are carried by the gripper/tucker-blade cylinder.

In accordance with still an additional feature of the invention, the folding apparatus includes a longitudinal-fold system adjacent the one cross-fold system, and means for conveying a stream of signatures from the one cross-fold system to the longitudinal-fold system.

In accordance with another aspect of the invention, there is provided, in folding apparatus for signatures having a given format, a cylinder section comprising a base frame, and two cross-fold systems operatable independently of one another and integrated in the base frame, each of the cross-fold systems comprising cylinders for guidingly carrying signatures having a given format, the signature-carrying cylinders being of such diameter as to have an outer cylindrical surface extending over the circumference thereof adequate for carrying one behind the other at one time at least two of the signatures having the given format.

In accordance with a further aspect of the invention, there is provided a folding apparatus for a printing machine having printing-unit cylinders of given like diameters for defining respective outer cylindrical surfaces thereon with a correspondingly like circumference, the folding apparatus including at least a first longitudinal folding device, a plurality of cylinders arranged in succession thereafter and followed by at least a second longitudinal folding device, and comprising a cylinder section having a base frame, and two cross-fold systems operatable independently of one another and integrated in the base frame, each of the cross-fold systems comprising cylinders for guidingly carrying signatures thereon, the signature-carrying cylinders having respective diameters for defining respective outer cylindrical surfaces thereon with circumferences equal to at least twice the circumference of the respective printing-unit cylinders.

In accordance with another feature of the invention, a first one of the cross-fold systems comprises a pin cylinder, a jaw cylinder and a gripper/tucker-blade cylinder in successive rotary engagement with one another, and wherein a second one of the cross-fold systems comprises the gripper/tucker-blade cylinder and a cutting/jaw cylinder in mutual rotary engagement.

In accordance with a further feature of the invention, the gripper/tucker-blade cylinder and the cutting/jaw cylinder have circumferences double the circumferences of each of the printing-unit cylinders, and the pin cylinder and the jaw cylinder have circumferences triple the circumferences of each of the printing-unit cylinders.

In accordance with an added feature of the invention, the second cross-fold system is located above the first cross-fold system, and respective upper and lower longitudinal-fold systems are provided, the upper longitudinal-fold system being disposed adjacent and operatively connected with the second cross-fold system, and the lower longitudinal-fold system being disposed adjacent and operatively connected with the first cross-fold system.

The manifold advantages derivable from this construction are based on the fact that two cross-fold systems, which are operatable independently of one another, are combined in one unit, so that accessory modules which require installation space and adjustment area may be dispensed with. Furthermore, the arrangement of the cross-fold systems above one another permits folders which have previously been installed to be subsequently equipped with an additional, independently operatable cross-fold system, the number of achievable folding variations being increasable considerably at minimal expense for modification and required installation space.

In accordance with a concomitant feature of the invention, respective means for conveying signature streams from the first cross-fold system to the lower longitudinal-fold system, and from the second cross-fold system to the upper longitudinal-fold system are provided.

Thus, in accordance with the invention, a first cross-fold system is provided which includes a tucker-blade cylinder, a jaw cylinder and a gripper/tucker-blade cylinder for a second cross-fold and a delta fold. A second cross-fold system is further provided which includes a gripper/tucker-blade cylinder for the second cross-fold and the delta fold, together with an integrated pin system as well as a cutting/jaw cylinder.

With this configuration, it is possible simultaneously to operate both cross-fold systems independently of one another, the gripper/tucker-blade cylinder being operated as though it belonged to the second cross-fold system. On the other hand, the first cross-fold system can be operated separately, the gripper/tucker-blade cylinder producing the second cross-fold and the delta fold, in this mode of operation.

Further in accordance with the invention, the first cross-fold unit feeds a product or signature stream to a lower longitudinal-fold system. In addition, a separate second transport path for at least one strand of webs is assigned to the second cross-fold system. This permits the feeding of a strand or length of webs to the second cross-fold system independently of the first cross-fold system. Furthermore, the second transport path is defined by a deflecting or diverting roller, a guide roller and a regulating roller. Assurance is thereby provided that a web strand or length will be fed in precise circumferential register to the second cross-fold system.

Also in accordance with the invention, means are provided in the gripper/tucker-blade cylinder and in the cutting/jaw cylinder for separating or severing a web strand or length. By integrating these separating or severing means in the gripper/tucker-blade cylinder and the cutting/jaw cylinder, a separate additional cutting cylinder in the second cross-fold system can be eliminated. The number of cylinders to be used in the base frame can thereby be kept low.

The means for separating or severing a web strand or length furthermore comprise at least two cutting bars as well as at least two blades. A respective blade can be carried both by the gripper/tucker-blade cylinder as well as by the cutting/jaw cylinder of the second cross-fold system. This applies as well to the rubber cutting bar assigned to each of the respective blades.

According to the invention, the gripper/tucker-blade cylinder of the second cross-fold system may also be equipped with at least two gripper bars. By means of these gripper bars, the products or signatures to be cross-folded in a separate operation of the first cross-fold system can be removed from the jaw cylinder, in order to permit further cross-folding operations to be performed by means of the gripper/tucker-blade cylinder.

By the fact that the second cross-fold system feeds a product or signature stream to an upper longitudinal-fold transfer cylinder, further in accordance with the invention, output options are created also for the product or signature stream being formed in the second cross-fold system, if both cross-fold systems are operated independently of one another.

Other features which are considered as characteristic for the invention are set forth in the appended claims.

Although the invention is illustrated and described herein as embodied in a rotary folding apparatus with a special cylinder arrangement for web-fed rotary printing machines, it is nevertheless not intended to be limited to the details shown, since various modifications and structural changes may be made therein without departing from the spirit of the invention and within the scope and range of equivalents of the claims.

Figure 1B:
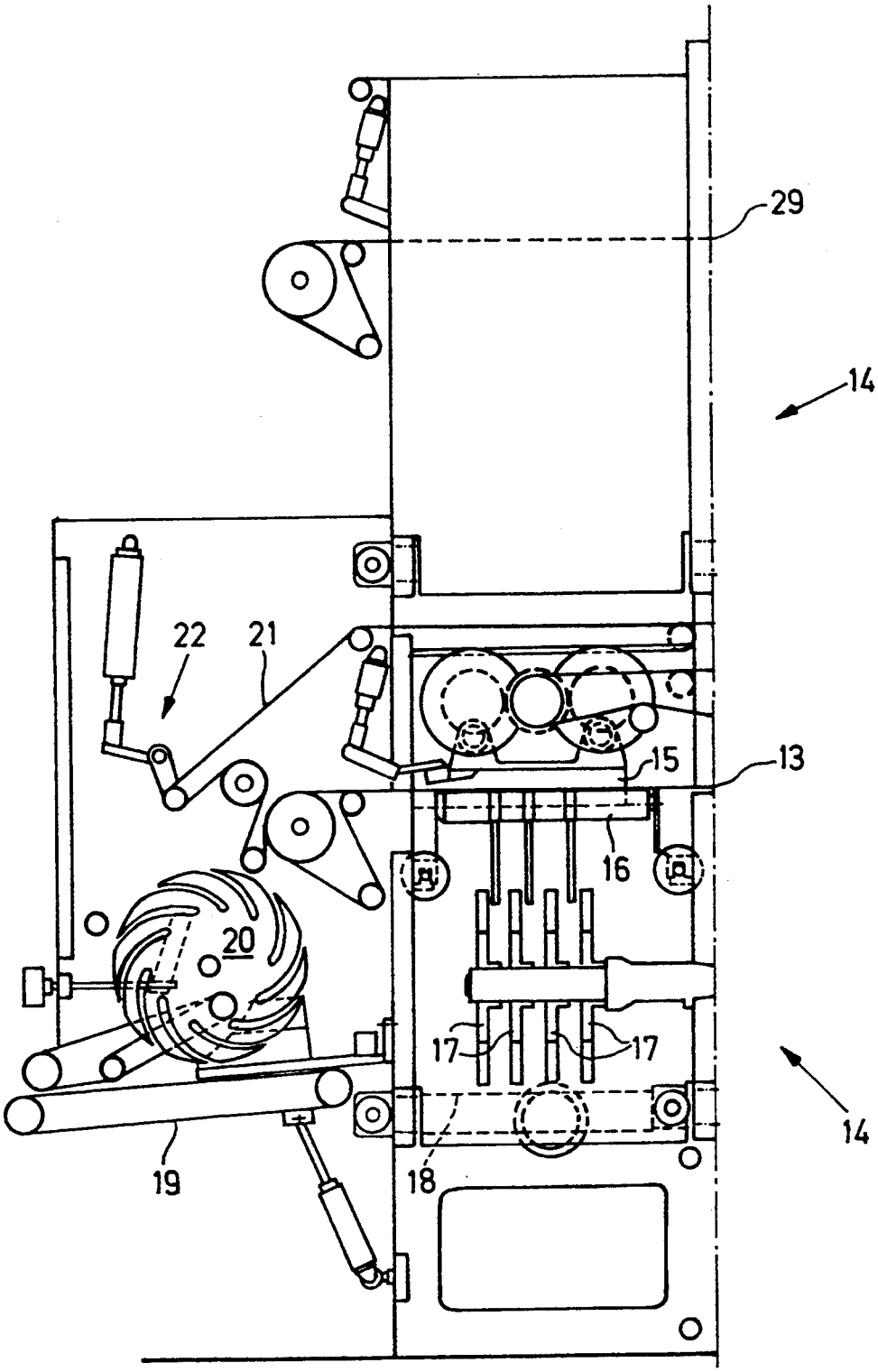
Figure 2:
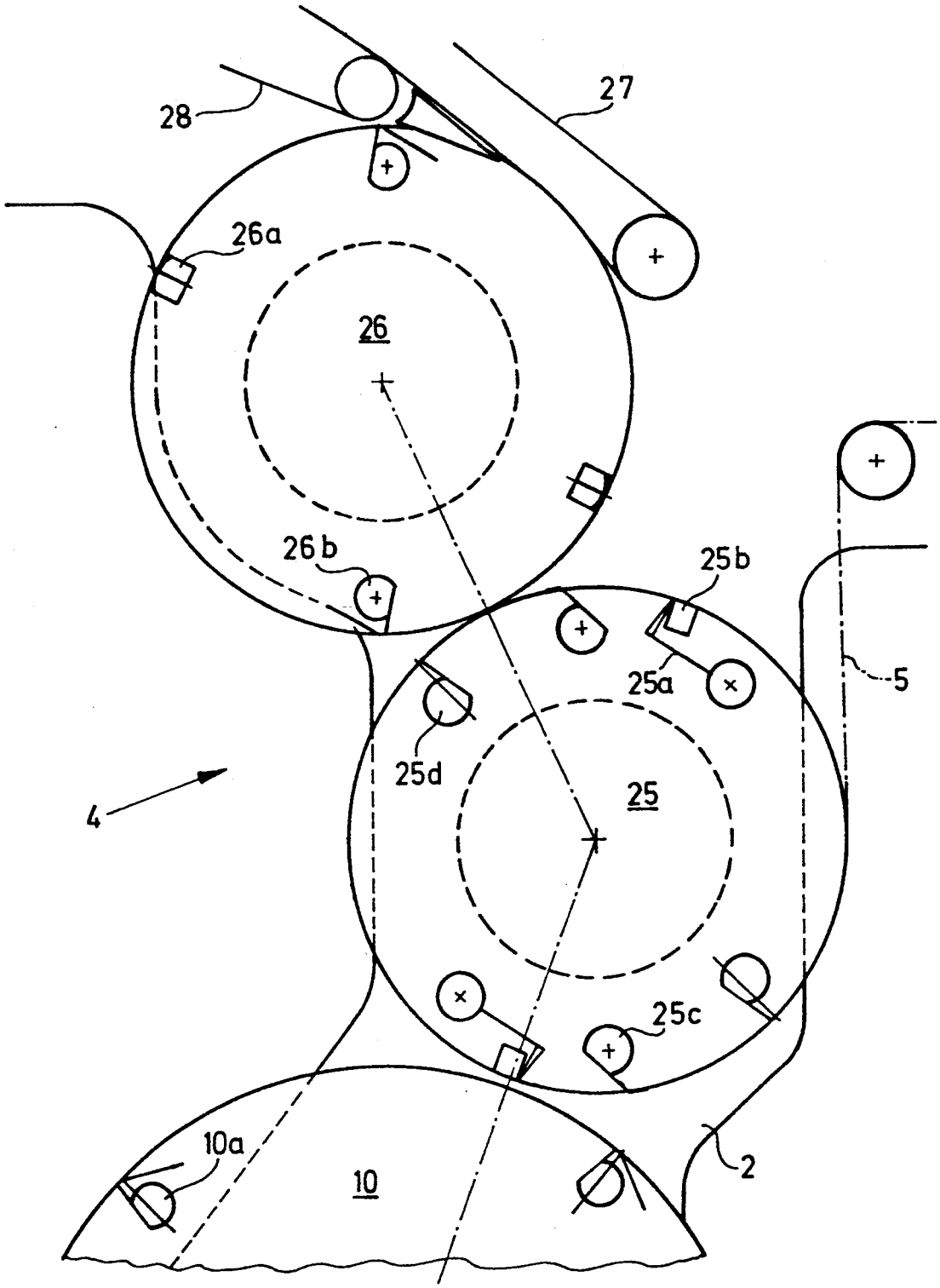
Figure 3:
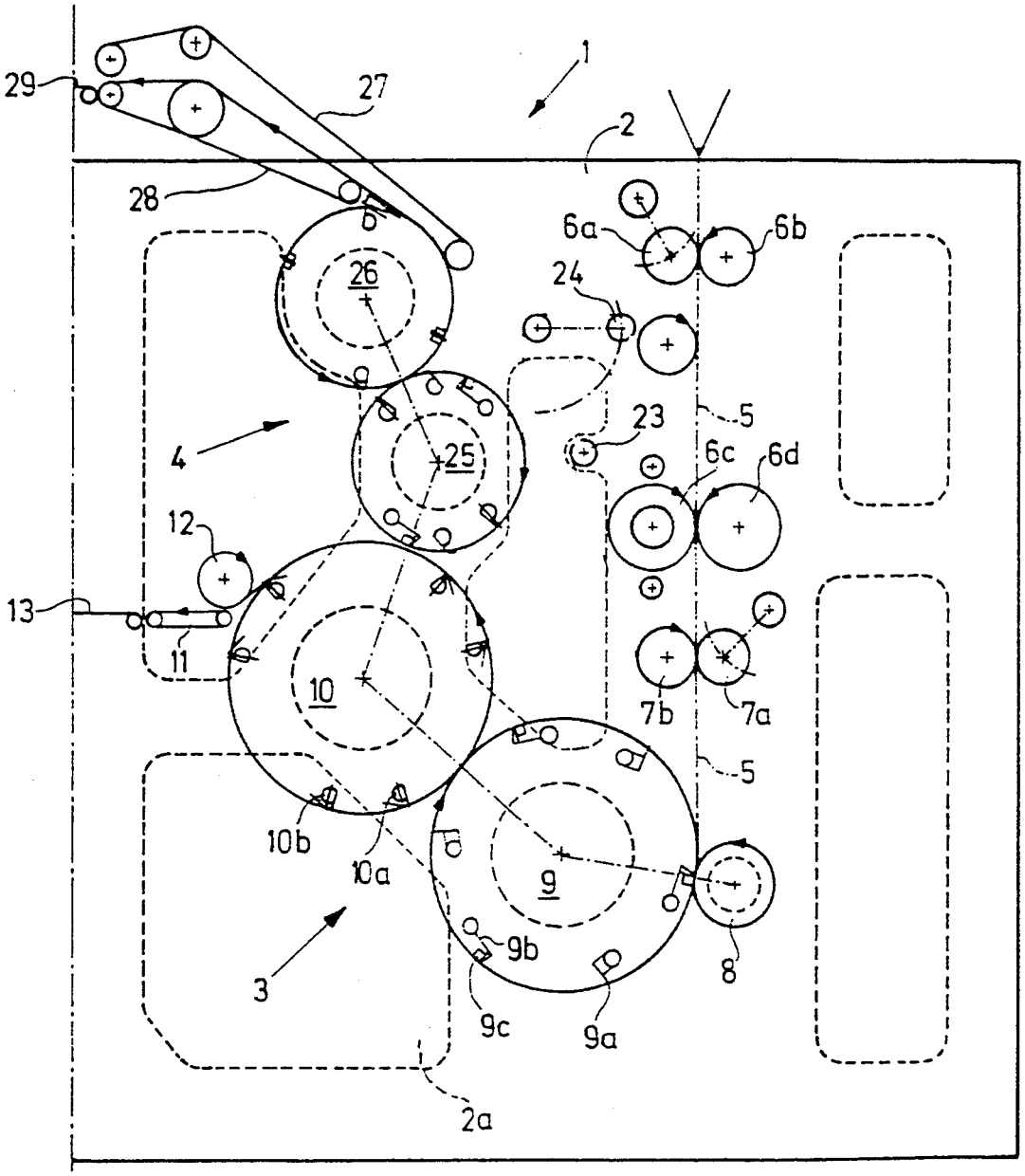
Figure 4:
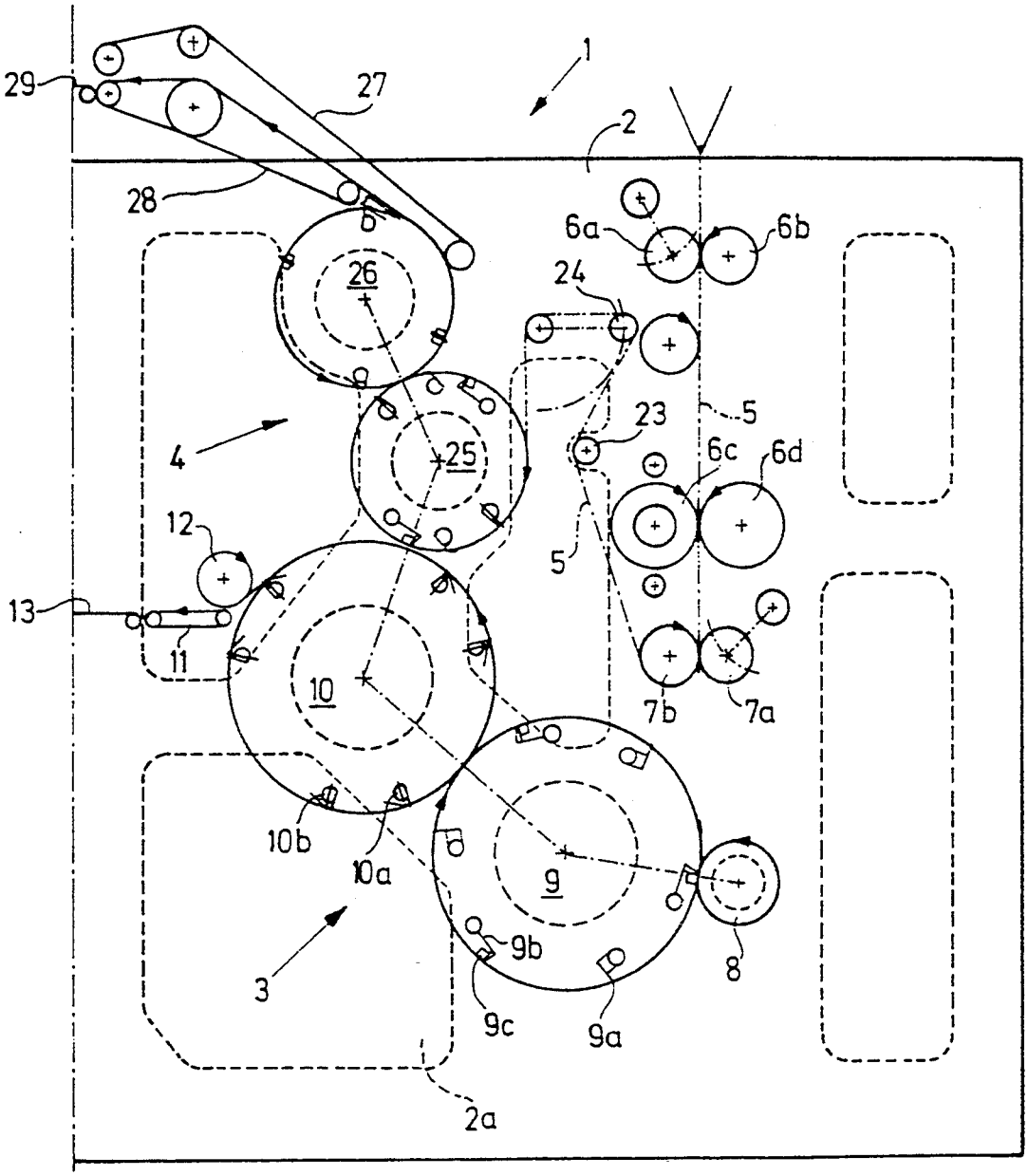

The construction and method of operation of the invention, however, together with additional objects and advantages thereof will be best understood from the following description of specific embodiments when read in connection with the accompanying drawings, in which:

FIG. 1*a* is a diagrammatic side elevational view of the base frame of a cylinder section of a folding apparatus with transfer locations at longitudinal-fold units;

FIG. 1*b* is a diagrammatic side elevational view of the base frame of a product-output section of the folding apparatus located to the left-hand side of FIG. 1*a*, and of a product delivery adjacent to the folding apparatus; and FIG. 2 is an enlarged fragmentary view of FIG. 1*a* showing a cutting/folding-jaw cylinder for a second cross-fold system, as well as a gripper/tucker-blade cylinder for first and second cross-fold systems, and FIGS. 3 and 4 are views similar to that of FIG. 1*a* of the folding apparatus for feeding respective web lengths independently to the respective first and second cross-fold systems.

Referring now to the drawings and, first, particularly to FIG. 1*a*, shown therein is a side elevational view of a base frame 2 of a cylinder section 1 of a folding apparatus, and transfer locations 13 and 29 at longitudinal-fold units 14 (FIG. 1*b*). As may be concluded from the description hereinbefore, FIG. 1*b* is on the left-hand side of and virtually contiguous with FIG. 1*a*.

The cylinder section 1 of the folding apparatus is formed of the base frame 2 which has two side walls extending parallel to one another and to the plane of the drawing in FIG. 2. The individual cylinders as well as the transport devices for at least one web length or strand 5 and the copies or signatures produced therefrom are disposed between the two side walls. The base frame 2 shown in FIG. 1*a* is formed with several recesses or cutouts 2*a* and holds two cross-fold systems 3 and 4 which can be operated independently of or in combination with one another.

The one or more web lengths or strands 5 vertically entering the base frame 2 are given a first longitudinal fold by a funnel-shaped former F and transported through the base frame 2 by transport and nip or draw rollers. A pair of nip rollers 6*a* and 6*b* is provided for this purpose, followed by a cross-perforation roller pair 6*c*, 6*d*. A second nip roller pair, formed of a diverting or deflecting roller 7*b* and a transport roller 7*a* engageable therewith, is arranged following the cross-perforation roller pair 6*c*, 6*d*. The two rollers 7*a* and 7*b* permit transport of the web lengths or strands 5 on two mutually independent transport paths which are assigned, respectively, to the cross-fold systems 3 and 4. A cutting cylinder 8 is disposed beneath the roller pair formed of the deflecting roller 7*b* and the transport roller 7*a*, which is pivotally engageable with the deflecting roller 7*b*, as is diagrammatically illustrated. The cutting cylinder 8 cooperates with a pin cylinder 9 of the cross-fold system 3. The pin cylinder 9 has rows of extensible pins 9*b* disposed on the outer cylindrical surface and about the circumference thereof. Near the rows of extensible pins 9*b*, cutting bars 9*c* are disposed at the circumference of the pin cylinder 9 and are impacted by a cutting blade mounted on and rotating together with the cutting cylinder 8 so as to cut off a copy or signature from the web length or strand 5. Between the individual rows of pins 9*b*, respective tucker or chopper blades 9*a* are provided, which tuck the pinned, cut-off copies or signatures into the folding jaws of a jaw cylinder 10 for forming a first cross fold. Folding jaw positions identified by reference characters 10*a* and 10*b* in FIG. 1*a*, represent the respective settings of the jaws on the circumference of the jaw cylinder 10 in the production mode of a first and a second cross fold (position 10*a*) and in the production mode of a delta fold (position 10*b*). Downstream from the cross-fold system 3, as viewed in the travel direction of the copy or signature, a conveyor belt 11 is disposed for conveying the copy or signature, which has been removed from the jaw cylinder 10 by a cylinder 12, to a lower longitudinal-fold transfer location 13, to which a longitudinal-fold unit 14 is connected.

In addition to feeding a web length or strand 5 to a cross-fold system 3, as shown in FIG. 3; it is possible to feed web lengths or strands 5 to a cross-fold system 4 alone, as shown in FIG. 4. In this regard, a web length or strand 5 is guided around the deflecting roller 7*b* and is diverted by a guide roller 23, via a regulating roller 24 which is individually adjustable for circumferential register, to a gripper/tucker blade cylinder 25 of the cross-fold system 4. The gripper/tucker blade cylinder 25 is arranged so that it can cooperate both with a cutting/folding jaw cylinder 26 in the cross-fold system 4 when the cross-fold systems 3 and 4 are supplied with web lengths or strands 5 independently of one another, as well as with the folding jaw cylinder 10 of the cross-fold system 3, for the purpose of forming the delta fold or the second cross fold, when the cross-fold system 3 is separately operated. The gripper/tucker-blade cylinder 25 is, thus, able to be tied in with each of the two cross-fold systems 3 and 4. The copies or signatures produced in the cross-fold system 4 are transported by conveyor belts or tapes 27, 28 to an upper longitudinal-fold transfer location 29 with which also another longitudinal-fold unit 14 is connected.

In the embodiment of the invention illustrated in FIG. 1*a*, the gripper/tucker-blade cylinder 25 and the cutting/folding jaw cylinder 26 have like circumferences 2× which are twice the circumference× of conventional printing-unit cylinders 100 of a web-fed rotary printing machine, i.e, the plate, blanket and impression cylinders thereof. Moreover, the pin cylinder 9 and the folding jaw cylinder 10 also have like circumferences 3×, however, the circumferences thereof are triple that of each of the aforementioned conventional printing-unit cylinders.

FIG. 1*b* forms a continuation of FIG. 1*a* and shows the delivery of the products or signatures coming from the folding apparatus. The longitudinal-fold units 14, respectively, are arranged after the longitudinal-fold transfer locations 13 and 29. Because both of the longitudinal-fold units 14 and the operations thereof are identical, only the lower longitudinal-fold unit 14 shown in FIG. 1*b* is illustrated in detail and described hereinafter. Each of the longitudinal-fold units 14 thus has a chopper or tucker blade 15 which pushes the conveyed cross-folded copies or signatures down between folding rollers 16, wherefrom they enter into individual fan pockets of fan disks 17. A delivery belt or tape system 18 running below the fan disks 17 transports the copies or signatures, which have thus been provided with a second longitudinal fold, out of the folding apparatus. Alternative to the formation of a second longitudinal fold, a possibility exists in the lower longitudinal fold unit 14 to convey the cross-folded copies or signatures through a tape system 21 into the fan pockets of a fan wheel 20 which is arranged at an angle of about 90° with respect to the fan disks 17. From the fan wheel 20, the copies or signatures, which have only been cross-folded, are delivered in a shingled stream onto a transport or conveyor belt 19. For maintaining and adjusting the initial tension within the tape system 21, a tape tensioning device 22 is installed.

FIG. 2 shows details of the cross-fold system 4. As mentioned hereinbefore, it is possible to operate the cross-fold system 4 independently of the cross-fold system 3. In such a mode of operation, the gripper/tucker blade cylinder 25 is tied in with the cross-fold system 4. The strand or length of web 5 entering the cross-fold system 4 is taken up by rows of pins 25*a* provided on the circumference of the gripper/tucker blade cylinder 25. Between the two rows of pins 25*a* located diametrically opposite one another on the gripper/tucker blade cylinder 25, two tucker blades 25*d* are provided. As the pinned web strand or length 5 enters the nip between the gripper/tucker blade cylinder 25 and the cutting- /jaw cylinder 26, it is cut by a blade 26*a* on the cutting-/jaw cylinder 26 which cooperates with a cutting bar 25*b* arranged on the gripper/tucker blade cylinder 25 close to the rows of pins 25*a*. As the gripper/tucker blade cylinder 25 continues to rotate, one of the aforementioned tucker blades 25*d* tucks the middle of the copy or signature into the folding jaw 26*b* of the cutting/jaw cylinder 26 then located opposite thereto. The folding jaw 26*b* takes hold of the folded spine of the copy or signature until it is finally severed, at its trailing end, from the pinned web strand or length 5 by a further cut from the blade 26*a* cooperating with the cutting bar 25*b*. Immediately thereafter, the signature or folded copy held in the folding jaw 26*b* is guided onto the conveyor tapes 27 and 28, by which it is fed to the upper longitudinal fold transfer location 29.

Thus, for changing-over to an additional cross-fold system, it would merely be necessary to equip the gripper/tucker-blade cylinder 25 with pin rows 25*a* and blades or selective cutting bars 25*b*. In this regard, it is of little importance whether the blades or the cutting bars are accommodated in the gripper/tucker-blade cylinder 25 or in the cutting/jaw cylinder 26. Minor modifications on the gripper/tucker blade cylinder 25 thus permit separate productions of 2×4 to 2×16-page products with a first cross-fold.

Furthermore, at least two gripper bars 25*c* are disposed on the circumference of the gripper/tucker-blade cylinder 25 and serve to form the second cross-fold or delta-fold when the cross-fold systems 3 and 4 are operated separately.

A more detailed explanation of some modes of production in the invention described more generally hereinbefore follows. The configuration of the cylinder section 1 of the folding apparatus permits mutually independent operation of the cross-fold systems 3 and 4. Multiple strands or lengths of webs 5, including those already longitudinally folded in the superstructure with the aid of the funnel or V-shaped former F shown at the top of FIG. 1*a*, can be fed simultaneously via respective separate transport paths, that is, via the deflecting roller 7*b*, the guide roller 23 and the regulating roller 24 to the cross-fold system 4, as well as in a vertical direction to the cross-fold system 3. This permits separate 2×4 to 2×16-page production in one folding apparatus. Each of the cross-fold systems 3 and 4 is followed by a respective longitudinal-fold unit 14, so that the respective product streams, if desired, merely have to be merged and joined by conventional means. Thus, the separate 2×4 to 2×16-page production mentioned hereinbefore occurs with a respective first cross-fold.

By switching the gripper/tucker-blade cylinder 25 and the cutting/jaw cylinder 26 over to second cross-fold or delta-fold production, a separate mode or type of production for the cross-fold system 3 can be achieved. In this mode of operation, only the cross-fold system 3 is fed or loaded with at least one web length or strand 5.

By feeding one web strand or length 5 to the cross-fold system 3, use can be made of the possibilities afforded by the cylinder arrangement 3:3:2. The gripper/-tucker-blade cylinder 25 is thereby tied into the cross-fold system 3. After the desired mode of operation, first and second cross-fold or delta-fold, has been pre-set and the respective folding jaws have been positioned, the formation of the first cross-fold occurs by pushing or tucking the copies or signatures into the folding jaws with the aid of the tucker blades 9*a* on the tucker blade cylinder 10, the folding jaws being in either the position 10*a* or 10*b*, depending upon the mode of operation. The copies or signatures formed with a first cross-fold are removed from the circumference of the folding jaw cylinder 10 by the gripper bar 25*c* of the gripper cylinder 25 in the cross-fold system 4. The tucker blades 25*d* of the gripper/tucker-blade cylinder 25 push or tuck the copies or signatures into the suitably positioned folding jaws of the folding jaw cylinder 10 so as to form the second cross-fold or the delta-fold. From there, the copies or signatures formed with the second cross-fold or the delta-fold pass into the longitudinal fold unit 14, can be longitudinally folded therein once again by means of the chopper blade 15, or directly, i.e., without a second longitudinal fold, conveyed into a fan wheel 20, from which they are delivered in a shingled stream onto an adjustable conveyor belt 19.

I claim:

1. Folding apparatus for signatures having a given format and including at least a first longitudinal folding device and at least a second longitudinal folding device, as well as respective first and second cross-fold systems operatable independently of one another on respective web lengths separately fed to each thereof, each of the first and second cross-fold systems including respective pairs of signature-guiding cylinders, one of the cylinders in the second cross-fold system comprising means for cutting the respective web length fed to the second cross-fold system in an operation performed independently of the first cross-fold system, and means for forming a second cross-fold in an operation performed in combination with the first cross-fold system.

2. Folding apparatus according to claim 1, wherein the second cross-fold system comprises a pin cylinder, a jaw cylinder and a gripper/tucker-blade cylinder in successive rotary engagement with one another.

3. Folding apparatus according to claim 2, including means defining a substantially vertical transport path for at least one web length to the second one cross-fold system.

4. Folding apparatus according to claim 2, including a longitudinal-fold system adjacent the second cross-fold system, and means for conveying a stream of signatures from the second cross-fold system to said longitudinal-fold system.

5. Folding apparatus according to claim 2, including a cutting cylinder operatively associated with the second cross-fold system.

6. Folding apparatus according to claim 1, wherein the cylinders of the first cross-fold system include a gripper/tucker-blade cylinder and a cutting/jaw cylinder in mutual rotary engagement.

7. Folding apparatus according to claim 6, including means defining a transport path for at least one web length to the first cross-fold system.

8. Folding apparatus according to claim 7, wherein said path-defining means comprise cooperatively engageable diverting and guide rollers, and a regulating roller disposed downstream therefrom in transport direction of said one web length.

9. Folding apparatus according to claim 6, including means carried by said gripper/tucker-blade cylinder and said cutting/jaw cylinder for cutting off a signature from the respective web length.

10. Folding apparatus according to claim 9, wherein said means for cutting off the signature comprise at least two cutting bars and at least two blades.

11. Folding apparatus according to claim 6, including at least two gripper bars carried by said gripper/tucker-blade cylinder.

12. Folding apparatus according to claim 6, including at least two rows of pins carried by said gripper/tucker-blade cylinder.

13. Folding apparatus according to claim 6, including a longitudinal-fold system adjacent the first cross-fold system, and means for conveying a stream of signatures from said one cross-fold system to said longitudinal-fold system.

14. Folding apparatus according to claim 1, wherein said second cross-fold system is located above said first cross-fold system, and including respective upper and lower longitudinal-fold systems, said upper longitudinal-fold system being disposed adjacent and operatively connected with said second cross-fold system, and said lower longitudinal-fold system being disposed adjacent and operatively connected with said first cross-fold system.

15. Folding apparatus according to claim 14, including respective means for conveying signature streams from said first cross-fold system to said lower longitudinal-fold system, and from said second cross-fold system to said upper longitudinal-fold system.

16. Folding apparatus for a printing machine having printing-unit cylinders of given like diameters for defining respective outer cylindrical surfaces thereon with a correspondingly like circumference, the folding apparatus including at least a first longitudinal folding device, a plurality of cylinders arranged in succession thereafter and followed by at least a second longitudinal folding device, and comprising a cylinder section having a base frame, and two cross-fold systems operatable independently of one another and integrated in said base frame, each of said cross-fold systems comprising cylinders for guidingly carrying signatures thereon, said signature-carrying cylinders having respective diameters for defining respective outer cylindrical surfaces thereon with circumferences equal to at least twice the circumference of the respective printing-unit cylinders, the first cross-fold system comprising a gripper/tucker-blade cylinder and a cutting/jaw cylinder in mutual rotary engagement, and the second cross-fold system comprising a pin cylinder, a law cylinder and the gripper/tucker-blade cylinder in successive rotary engagement and said gripper/tucker-blade cylinder and said cutting/jaw cylinder have circumferences double the circumferences of each of the printing-unit cylinders, and said pin cylinder and said jaw cylinder have circumferences triple the circumferences of each of the printing-unit cylinders.

* * * * *

UNITED STATES PATENT AND TRADEMARK OFFICE

CERTIFICATE OF CORRECTION

PATENT NO. : 5,386,979
DATED : February 7, 1995
INVENTOR(S) : Hans Muller

It is certified that error appears in the above-indentified patent and that said Letters Patent is hereby corrected as shown below:

On the title page, item [30], change

" Apr. 16, 1992 [DE] Germany ..... 4208353 "

to

-- Mar. 16, 1992 [DE] Germany ..... 4208353 --.

Signed and Sealed this

Tenth Day of October, 1995

*Attest:*

*Attesting Officer*

Bruce Lehman

BRUCE LEHMAN

*Commissioner of Patents and Trademarks*